United States Patent [19]

Shimoi et al.

[11] Patent Number: 4,735,068

[45] Date of Patent: Apr. 5, 1988

[54] CARD OPERATED LOCK

[75] Inventors: Osamu Shimoi, Watarai; Yoshiaki Katoh, Tokyo, both of Japan

[73] Assignee: Miwa Lock Co., Ltd., Tokyo, Japan

[21] Appl. No.: 25,280

[22] Filed: Mar. 12, 1987

[51] Int. Cl.[4] ..... E05B 21/00

[52] U.S. Cl. ..... 70/349; 70/355; 70/421

[58] Field of Search ..... 70/349, 355, 421, 354, 70/353, 352, 351, 350, 339

[56] References Cited

U.S. PATENT DOCUMENTS

| | | | |
|---|---|---|---|
| 3,555,858 | 1/1971 | Owen | 70/352 |
| 3,595,042 | 7/1971 | Sedley | 70/352 |
| 4,114,410 | 9/1978 | Astier | 70/355 |
| 4,400,955 | 8/1983 | Di Motta | 70/421 |

FOREIGN PATENT DOCUMENTS 58-123980 7/1983 Japan .

*Primary Examiner*—Robert L. Wolfe

*Attorney, Agent, or Firm*—Wenderoth, Lind & Ponack

[57] ABSTRACT

A card operated lock includes a lock box in which an inner card slit opened to the interior of a room and a outer card slit opened to the exterior of the room are disposed in substantially coplanar relationship with each other. A lock card having a predetermined pattern of punched engaging holes is inserted previously into the inner card slit while a key card comprising the same pattern of punched engaging holes as the lock card is inserted into the outer card slit when the lock is unlocked or opened. A plurality of rocking tumblers each of which is substantially in the form of a T-shaped plate are inserted into the lock box in the form of an array extended in the widthwise direction of the key card and perpendicular to the card slits. A horizontal bar portion of each T-shaped rocking tumbler is extended along both the inner and outer card slits. Each T-shaped rocking tumbler is biased in a direction in which a pair of detection projections extended from the horiozntal bar portion of the T-shaped rocking tumbler in symmetric relationship with each other with respect to a vertical bar portion of the T-shaped rocking tumbler are pressed against the lock and key cards inserted in the inner and outer card slits. Each T-shaped tumbler is guided so that it can be displaced over a distance at least equal to the thickness of the card in the direction of thickness thereof and it can be rocked or swung, whereby the punched engaging hole patterns of the lock and key cards are determined to be coincident with each other depending upon whether or not all rocking tumblers are maintained upright.

4 Claims, 4 Drawing Sheets

CARD OPERATED LOCK

BACKGROUND OF THE INVENTION

The present invention relates to a card operated lock in which a so-called mechanical card lock of the type using a punched card as a proper key incorporates there in a so-called pin tumbler.

Even though there has been a strong demand to easily change a cylinder lock of a room at any suitable time in order to prevent a mala fide person from unlocking or opening the lock of the room by using a duplicated key and stealing articles from that room in hotels or the like where various guests stay, it has been considerably difficult to do so because it takes a long period of time and is cumbersome to replace an old cylinder with a new one in the case of a mechanical cylinder lock.

In order to overcome such problem, there have been devised and demonstrated electrical locks of the type which can be unlocked or opened when magnetic cards or punched cards are used as proper keys. However, such electrical locks comprise a power supply, a card reader, a control unit and an electronic lock so that they are very complicated in construction and consequently are very expensive. Furthermore, considerably high costs and much labor are required to install such electrical locks and accomplish associated wiring operations.

In view of the above, a novel mechanical locking device of the type using a punched card as a proper key is disclosed in detail in Japanese Patent Application No. 6805/1982 (Japanese Patent Application Laid-Open No. 123980/1983), whereby the above-described problems are satisfactorily overcome to some extent.

SUMMARY OF THE INVENTION

The primary object of the present invention is to provide a card operated lock which can further improve the function of the locks and the prevention of crime by improving the lock disclosed in detail in the above-described Japanese Patent Application No. 6805/1982.

In order to attain the above-described object, the present invention is characterized by comprising a lock box in which an inner card slit, which is opened to the interior of a room and into which is inserted a lock card with punched engaging holes, and an outer card slit, which is opened to the exterior of said room and into which is inserted a key card with punched engaging holes, are extended in substantially coplanar relationship with each other. A stationary block is securely disposed within said lock box and has a plurality of slits arranged in succession in the widthwise direction of said key card substantially perpendicular to said inner and outer card slits. A plurality of rocking tumblers, each of which is substantially in the form of a T-shaped plate as a whole, are inserted into respective said tumbler slits in such a way that the horizontal bar portion of each T-shaped rocking tumber extends over both of said inner and outer card slits, and each has a pair of detection projections for detecting said engaging holes extended from the end portions of said horizontal bar portion facing both said inner and outer card slits and in symmetrical relationship with each other about the vertical bar portion of said T-shaped rocking tumbler. Each T-shaped rocking tumbler is biased in the direction of said lock and key cards inserted into said inner and outer card slits, respectively, such that said T-shaped rocking tumbler can be displaced in the direction of the thickness of said lock and key cards by a distance at least equal to the thickness of said lock and key cards and that said T-shaped tumbler can be rocked. A movable block which is disposed on the side of said stationary block opposite the side facing said inner card slits for slidable movement in the widthwise direction of said key card. The movable block has relief or tolerance slits in each of which is permitted the rocking motion of the leading end of said vertical bar portion of a respective said rocking tumbler in the locked state and has grooves extended perpendicular to said relief or tolerance slits for receiving therein the rocking ends of said vertical portions of said T-shaped rocking tumblers which are extended out of said stationary block when said T-shaped rocking tumblers are extended upright substantially perpendicular to said inner and outer card slits. At least one assembly of a tumbler pin and a driver pin is extended through the surface of sliding contact between said stationary and movable blocks on the exterior side of said T-shaped rocking tumblers for axial slidable movement and is biased in the direction in which the leading end of said tumbler pin is forcibly pressed against said key card. The length of said tumbler pin is so determined that the surface of contact between said tumbler pin and said driver pin is aligned with the surface of sliding contact between said stationary and movable blocks depending upon whether or not the portion of said key at which the leading end of said tumbler pin is brought into contact with said key card has an engaging hole.

The above and other objects, effects, features and advantages of the present invention will become more apparent from the following description of the preferred embodiment thereof taken in conjunction with the accompanying drawings.

DESCRIPTION OF THE PREFERRED EMBODIMENT

Now a preferred embodiment of the present invention will be described below with reference to the accompanying drawings.

Figure 1:
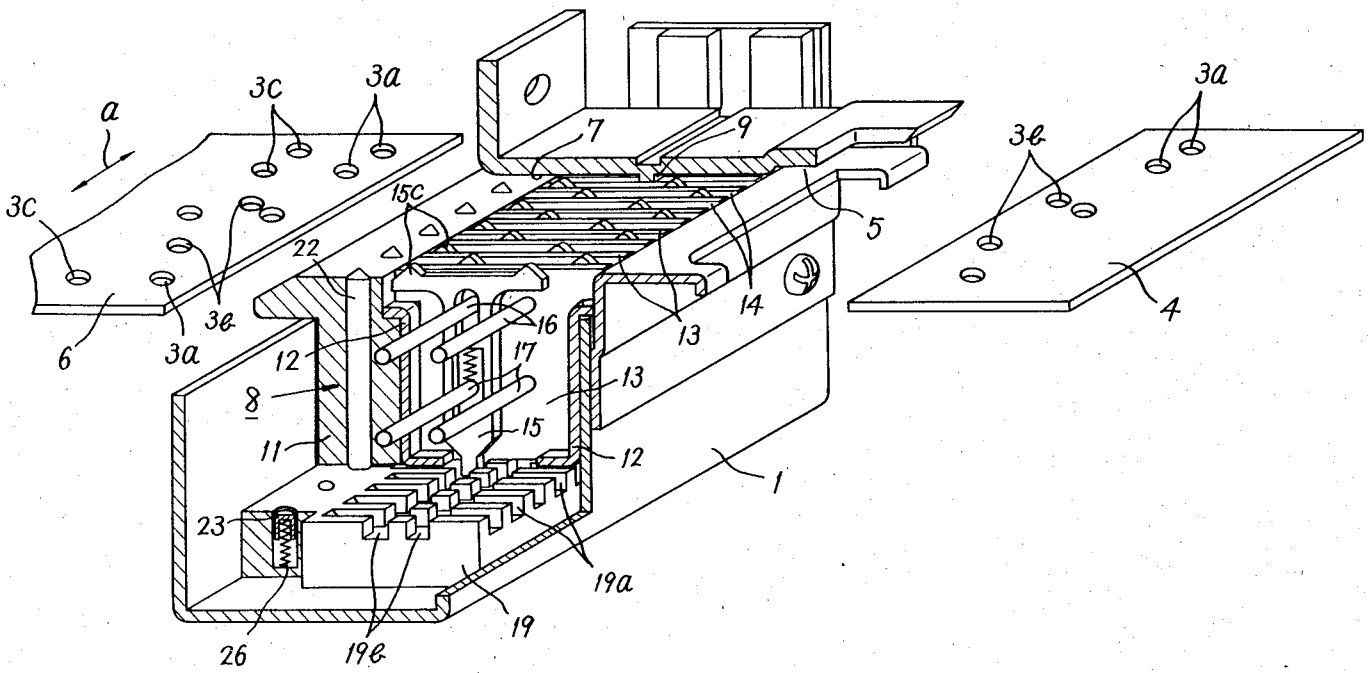
FIG. 1 is a perspective view of a preferred embodiment of a card operated or activated lock in accordance with the present invention with parts broken away and parts shown in full.
Figure 2:
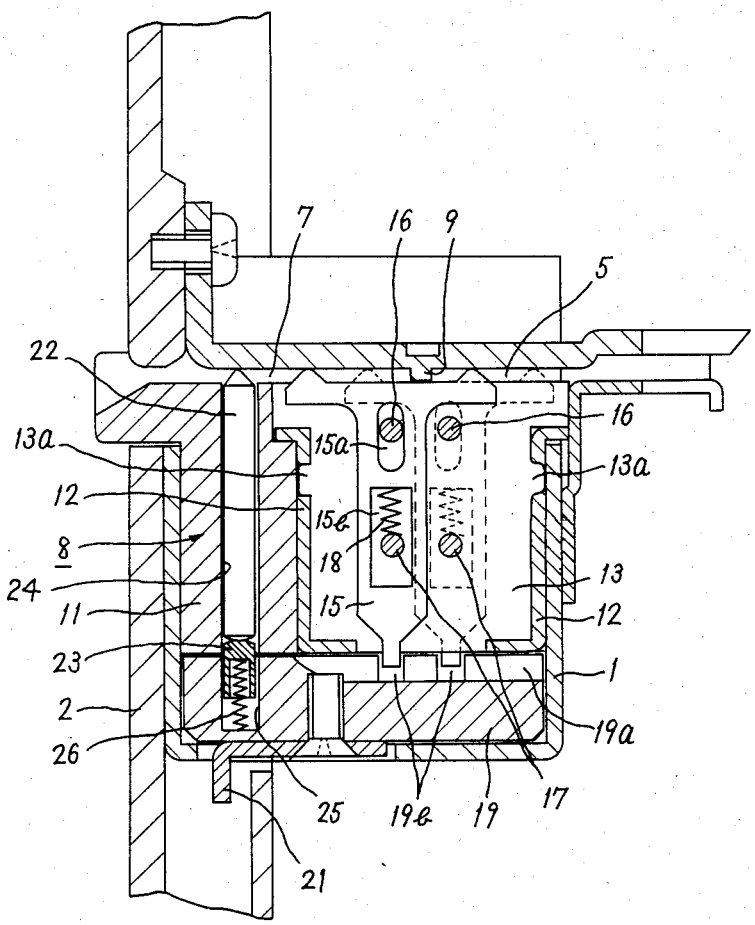
FIG. 2 is a sectional view thereof with no lock and key card being inserted.

In FIGS. 1 and 2, reference numeral 1 designates a lock box which is mounted through an escutcheon 2 on a door not shown.

The lock box 1 has, for instance, at its upper portion an inner card slit 5 which is opened toward the interior of a room and into which is inserted a lock card 4 (See FIG. 1) having a predetermined pattern of engaging holes 3 and an outer card slit 7 which is opened toward the exterior of the room and into which is inserted a key card 6 having the same pattern of engaging holes 3. The inner and outer card slits 5, 7 are substantially in coplaner relationship with each other and are defined between the top plate of the lock box 1 and a stationary block 8 to be described in detail below. A partition ridge 9 is integrally extended from the inner surface of the top plate of the lock box 1 so that the inner and outer card slits 5 and 7 are separated from each other and the downwardly extended partition ridge 9 determines the depth of insertion of a lock card 4 and a key card 6 inserted into the inner and outer card slits 5 and 7, respectively, because the leading edges of these cards 4 and 6 are made into contact with the partition ridge 9 when they are inerted. The construction of the lock and key cards inserted into the inner and outer card slits 5 and 7, respectively, will be described in more detail in conjunction with the construction of rocking tumblers to be described below.

The stationary block generally indicated by the reference numeral 8 is securely disposed within the lock box 1 and comprises a pin block 11 which has a substantially L-shaped cross sectional configuration and which is adapted to guide tumbler pins to be described below and a plurality of partition plates 13 which are held by holding plates 12 between the inner side plates of the lock box 1, spaced part from each other by a predetermined distance in parallel with each other and arranged in the widthwise direction (that is, the direction indicated by an arrow a in FIG. 1) of the key card 6. Ears 13*a* are extended outwardly from both sides of each partion plate 13 and are fitted into rectangular holding holes formed through each holding plate 12 as best shown in FIG. 2. Therefore, a plurality (20 in this embodiment) of tumbler slits 14 are defined in the widthwise direction of the key card 6 and perpendicular to the inner and outer slits 5 and 7 and the upper ends of the tumbler slits 14 are comunicated with the inner and outer card slits 5 and 7.

Each of the tumbler slits 14 receives and holds therein a rocking tumbler 15 which is in the form of a substantially T-shaped plate as a whole.

As best shown in FIG. 2, each rocking tumbler 15 has a longitudinally elongated guide slot 15*a* formed at the portion at which the horizontal and vertical bars of the T-shaped rocking tumbler 15 intersect each other and into which is slidably fitted a guide rod 16 extended through the stationary block 8 in the widthwise direction of the key card 6 in such a way that the rocking tumbler 15 can be displaced in the vertical direction in FIG. 2; that is, in the direction perpendicular to the card slits 5 and 7 by a distance corresponding to the thickness of the lock card 4 or the key card 6 and by an amount the lower end of a vertical bar extended downwardly beyond the bottom of the stationary block 8 is permitted to swing or rock.

Furthermore, each rocking tumbler 15 is formed with a spring hole 15*b* which is, for instance, in the form of a rectangle and which is located downwardly of and spaced apart from the guide hole 15*a* by a predetermined distance. A spring rod 17 which is extended through the stationary block 8 in parallel with the guide rod 16 downwardly thereof is loosely fitted into the spring hole 15*b* and a first tumbler spring 18, which is a compression spring, is loaded between the upper end of the spring hole 15*b* and the spring rod 17 so that each rocking tumbler 15 is normally biased in the direction toward the card slits 5 and 7.

The length of the horizontal bar of each rocking tumbler 15 is so selected that the rocking tumbler 15 is extended along both of the inner and outer card slits 5 and 7. A pair of detection projections 15*c* are extended upwardly from both ends of the horizontal bar of the T-shaped rocking tumbler 15 in such a way they are substantially symmetric about the vertical bar of the T-shaped rocking tumbler 15. In this embodiment, each detection projection 15*c* has inclined coverging edges so that the insertion of the lock and key cards 4 and 6 into their respective card slits is facilitated.

In this embodiment, two guide rods 16 and two spring rods 17 for guiding the rocking tumblers 15 are extended so as to be symmetric about the downwardly extended partition ridge 9 of the top plate, and they are slidably fitted into the guide holes 15*a* and loosely fitted into the spring holes 15*b* of alternate rocking tumblers 15, 15. As a result, the pairs of detection projections 15*c*, 15*c* of the rocking tumblers 15 are alternately staggered with respect to each other so that, as best shown in FIG. 1, four arrays of the detection projections 15*c* which are spaced apart from each other by the same distance in the widthwise direction of the key card 6 are defined in the direction in which the key card 6 is inserted into its corresponding card slit.

In the card operated lock in accordance with the present invention, different key combinations are obtained depending upon whether or not the engaging holes of the lock and key cards 4 and 6 are aligned or registered with the detection projections 15*c* when the lock and key cards 4 and 6 are inserted into the inner and outer card slits 5 and 7, respectively, until they are stopped by the downwardly extended partition ridge 9 of the top plate. That is, one of each pair of detection projections 15*c* of each rocking tumbler 15 detects whether or not the corresponding engaging hole 3 is punched through the lock card 4, while the other detection projection 15*c* detects whether or not the corresponding engaging hole 3 is punched through the key card 6.

As described above, two arrays of the rocking tumblers 15 are extended along the direction in which the key card 6 is inserted into its card slit so that each of the lock card 4 and the key card 6 has two arrays of engaging holes extended in the direction in which the key card 6 is inserted into its card slit. These arrays are staggered from each other by the distance equal to the distance between the adjacent rocking tumblers 15 in the widthwise direction of the key card 6. As a result, the spacing between the engaging holes 3 of the key card 6 can be made longer so that the outer diameter of each engaging hole 3 into which is inserted a detection projection 15*c* is increased and consequently the locking or unlocking operation is ensured. Furthermore, the portions at which the engaging holes are punched through are increased in number so that a large number of various key combinations (or engaging hole patterns) can be obtained. In this embodiment, the array of the rocking tumblers 15 indicated by the solid lines in FIG. 2 corresponds to the array of engaging holes 3*b* in each of the key and lock cards 4 and 6 shown in FIG. 1, while the array of the rocking tumblers 15, indicated by the broken lines in FIG. 2 corresponds to the array of the engaging holes 3*a* of each of the key and lock cards 4 and 6.

Meanwhile, a movable block 19 which is, for instance, in the form of a flat block, is slidably interposed between the stationary block 8 and the bottom surface of the lock box 1 in such a way that the movable block 19 is slidable in the widthwise direction of the key card 6; that is, in the direction perpendicular to FIG. 2.

Relief or tolerance slits 19*a*, equal in number to the number of tumbler slits 14, are formed in the upper surface of the movable block 19 in opposed relationship with the stationary block 8 so that in the locked state, they are aligned with the tumbler slits 14 of the stationary block 8, thereby permitting a rocking or swinging motion of the rocking end or the leading end of the vertical bar of each T-shaped rocking tumbler 15.

Furthermore, the upper surface of the movable block 19 is formed with grooves **19*b* at right angles with the relief or tolerance slits 19*a* so that when the vertical bars of the T-shaped rocking tumblers 15 become substantially perpendicular to the card slits 5 and 7, their rocking ends are inserted into the grooves 19*b***.

As best shown in FIG. 2, an operating member 21 is formed integral with, for instance, the lower or bottom surface of the movable block 19 and the outer end of the operating member 21 is extended beyond the lock box 1 to the exterior and is made to engage with a locking bolt operating member (not shown) which is activated by a knob or a handle mounted on the outer surface of the door.

Within the lock box 1 and on the outer side of the rocking tumbler group, a plurality of assemblies each consisting of a tumbler pin 22 and a driver pin 23 are arranged in an array in the widthwise direction of the key card 6. As best shown in FIG. 2, each tumbler pin 22 is slidably fitted into a first pin hole 24 extended through the pin block 11 perpendicular to the card slit while the driver 23 pin is slidably fitted into a second pin hole 25 which is extended downwardly from the upper surface of the movable block 19, which becomes coaxial with the first pin hole 24 in the locked mode. A second tumbler spring 26, which is a compression spring, is loaded in the second pin hole 25 so that the assembly of the tumbler pin 22 and the driver pin 23 is biased to move upwardly in FIG. 2; that is, in the direction in which it is forced to be pressed against the key card 6 inserted into the outer card slit 7.

In accordance with the present invention, further key combinations (or engaging hole patterns) can be obtained depending upon whether or not engaging holes **3*c* (See FIG. 1) are punched at portions of the key card 6 at which the upper ends, in the form of, for instance, cones, of the tumbler pins 22 are made to contact with the key card 6 when inserted into the outer card slit 7**.

Therefore, in response to the key combinations (or engaging hole patterns) determined by the number and arrangement of the engaging holes **3*c* of the key card 6 shown in FIG. 2, the corresponding tumbler pins 22 are varied in length so that they have two different lengths. The tumbler pin 22 shown in FIG. 2 corresponds to a portion of the key card 6 at which no engaging holes 3*c* is punched. It follows therefore that when the key card 6 is inserted into the outer card slit 7, the unpunched portion thereof in contact with the upper end of the tumbler pin 22 forces the tumbler pin 22 to move downwardly against the force of the second tumbler spring 26 so that the surface of contact between the tumbler pin 22 and the drive pin 23 is aligned with the surface of sliding contact between the stationary block 8 and the movable block 19; that is, a shear line (See FIG. 3). The length of the tumbler pin 22 corresponding to the opening of the engaging hole 3*c* of the key card 6 is such that the surface of contact between the tumbler pin 22 and the driver pin 23 is aligned with the shear line when the key card 6 is not inserted, but when the upper end of the tumbler pin 22 is brought into contact with an unpunched portion of the key card 6 inserted into the outer card slit 7, the lower end of the tumbler pin 22 shown in FIG. 2** crosses the shear line (not shown).

In the case of the card operated lock with the above-described construction, the lock card 4 in which the number and arrangement pattern of the engaging holes **3*a* and 3*b* are, for instance, shown in FIG. 1 is inserted into the inner card slit 5. The key card 6 corresponding to the lock card 4 is the same as the lock card 4 in the number and arrangement of engaging holes 3*a* and 3*b* corresponding to the rocking tumblers 15. Furthermore, in response to the combinations of the tumbler pins 22 different in length, the number and arrangement of the engaging holes 3*c* for engagement with the tumbler pins 22** are selected suitably.

In the locked mode, that is, when the key card 6 is not inserted into the outer card slit 7, the upwardly extended detection projections **15*c* of all the rocking tumblers 15 which face the outer card slit 7 are forced to be pressed against the inner surface of the top plate of the lock box 1 under the forces of the first tumbler springs 18**.

On the other hand, at least one of the detection projections **15*c* is brought into engagement with an unpunched portion of the lock card 4 where no engaging hole 3 is punched so that the rocking end of the vertical bar of this T-shaped rocking tumbler 15 is forced to swing outwardly and is inserted into the relief or tolerance slit 19*a* (not shown). Furthermore, as shown in FIG. 2, at least one driver pin 23 crosses across the surface of sliding contact between the stationary block 8 and the movable block 19** or the shear line.

As a result, the movable block 19 cannot be displaced in the widthwise direction of the key card 6 in relation to the stationary block 8 so that the operating member 21 cannot be moved and consequently the card operated or activated lock remains in the locked mode or state.

When the key card 6 which is a proper key corresponding to the lock card 4 is inserted in the outer card slit 7, the portions of the lock and key cards 4 and 6 with which the pair of detection projections **15*c* of each tumbler 15 are brought into contact have the engaging holes 3** or do not have them without exception.

Figure 3:
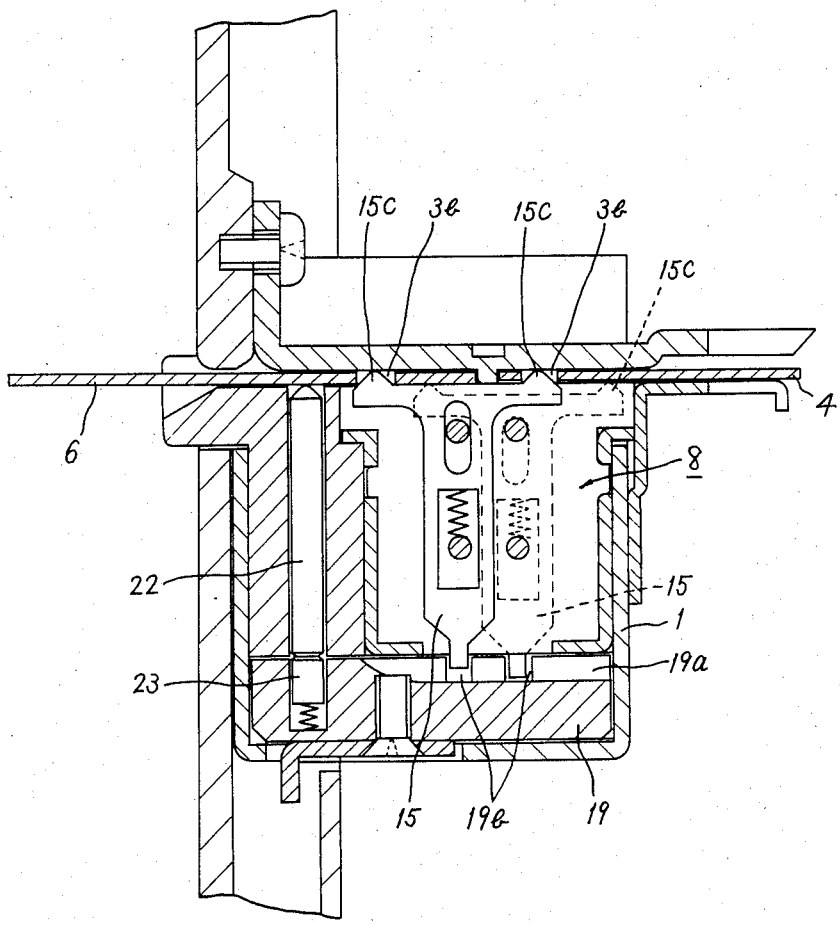
FIG. 3 is a view similar to FIG. 2 but illustrates a proper key card inserted.
Figure 4:
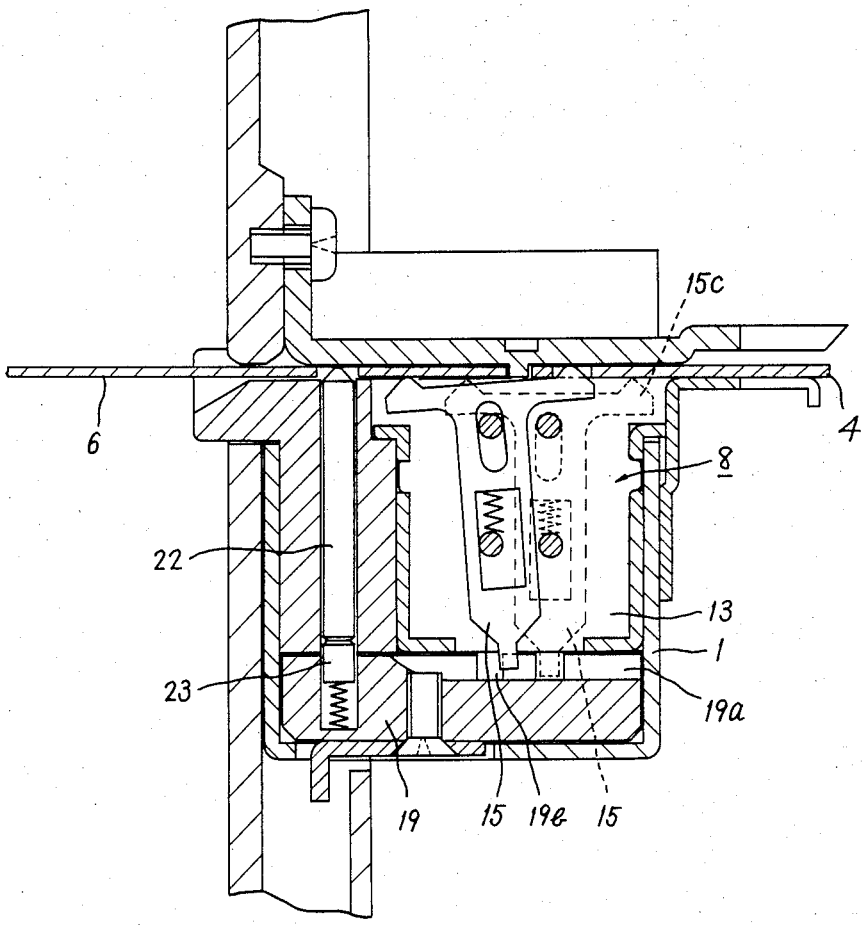
FIG. 4 is a view similar to FIG. 2 but illustrates that a key card which is different from the proper key card is inserted.

Therefore, as shown in FIG. 3, both of the detection projections **15*c* of each rocking tumbler 15 are brought into contact with the inner surface of the top plate of the lock box 1 or with the lock card 4 or the key card 6 so that all the rocking tumblers 15 are forced to extend upright so that all the rocking ends of the vertical bars of the T-shaped rocking tumblers 15 are inserted into the grooves 19*b***.

Alternatively, as best shown in FIG. 3, all the surfaces of contact between all the tumbler pins 22 and driver pins 23 are aligned with the shear line. As a consequence, the movable block 19 is permitted to move in relation to the stationary block 8 so that the lock can be unlocked or opened.

When a key card which is different from the proper key card 6 is inserted into the outer card slit 7, at least one rocking tumbler 15 and/or tumbler pin 22 detects a key combination so that the rocking tumbler 15 is caused to incline, whereby its rocking end is inserted into the relief or tolerance hole **19*a*, while the tumbler pin 22 or the driver pin 23 connected therewith is forced to cross across the shear line between the stationary and movable blocks 8 and 19 so that the movable block 19** cannot slide in relation to the stationary block 8 and consequently it is impossible to unlock or open the lock.

As is apparent from the above-described embodiment, according to the present invention when the lock card and the key card are not completely identical to each other in the number of engaging holes and their pattern, it is impossible to unlock or open the lock so that when the lock card is replaced with another lock card having a different number of engaging holes and a different engaging hole pattern, a different key combination can be obtained in a very simple manner. When the lock card is replaced periodically or every day, it becomes impossible to unlock or open the lock and enter the room even when a guest who stayed previously in the same room duplicates the key lock that he received at that time. Thus the safety of the lock and the prevention of crimes can be remarkably improved.

Furthermore the lock of the present invention comprises all mechanical component parts so that, unlike the above-described electrical card lock systems, not only various electric or electronic devices such as a power supply, card readers, control units and so on but also the installation of wiring systems can be completely eliminated. As a result, the present invention can provide the card operated or activated lock system at an extremely low cost. Of course, each of the locks in accordance with the present invention can function independently so that they can be used with the doors in residential houses.

In addition, the rocking tumblers are in the form of thin plates and are comparatively compact in size, and a relatively large number of them can be incorporated into each lock so that a large number of various key combinations can be obtained. For instance, when a lock in accordance with the present invention has 20 rocking tumblers, $2^{20}$ or about one million key combinations can be obtained only by the rocking tumblers. Furthermore, when the same lock further incorporates therein ten tumbler pins, a total of about one billion key combinations can be obtained.

As compared with the invention disclosed in the above-described Japanese Patent Application No. 6805/1982, the tumbler pins are increased in number so that the unlocked state in which one can unlock or open the lock without inserting the key card when a hotel service person has forgotten to insert the lock card into the inner card slit 5 can be prevented.

Furthermore, during the step of unlocking the lock, the pin holes which receive therein the tumbler pins and driver pins are staggered and not aligned so that the axial movement of the tumbler pin inserted into at least one tumbler pin engaging hole of the key card is restricted and consequently during the unlocking step, the key card cannot be pulled out of the outer card slit. Therefore, various problems caused by pulling out the key card during the step of unlocking, such as the problem that a guest goes out, leaving, for instance, the locking bolt unextended beyond the free vertical side edge of the door, can be prevented.

Moreover, of course the key combinations are increased in number as the tumbler pins are increased in number. The key combinations obtained by various combinations of these tumbler pins can be used as hotel codes which are used to distinguish one hotel from another.

What is claimed is:

1. A card operated lock comprising:

a lock box having an inner card slit which is opened at the interior of a room and into which is inserted a lock card with punched engaging holes and an outer card slit which is opened at the exterior of said room and into which is inserted a key card with punched engaging holes, said inner and outer card slits extending in substantially coplanar relationship with each other;

a stationary block which is securely disposed within said lock box and which has a plurality of tumbler slits arranged in succession in the widthwise direction of said key card substantially perpendicular to said inner and outer card slits;

a plurality of rocking tumblers each of which is substantially in the form of a T-shaped plate as a whole, which is inserted into a respective of said tumbler slits in such a way that a horizontal bar portion of said T-shaped rocking tumbler extends over both of said inner and outer card slits, which has a pair of detection projections for detecting said engaging holes and extended from end portions of said horizontal bar portion facing said both inner and outer card slits and in symmetrical relationship with each other about a vertical bar portion of said T-shaped rocking tumbler, and which is so guided that said T-shaped rocking tumber is biased in the direction of said lock and key cards inserted into said inner and outer card slits, respectively, that said T-shaped rocking tumbler can be displaced in the direction of the thickness of said lock and key cards by a distance at least equal to the thickness of said lock and key cards and that said T-shaped tumbler can be rocked;

a movable block disposed on the side of said stationary block opposite the side thereof facing said inner and outer card slits for slidable movement in the widthwise direction of said key card, said movable block having relief or tolerance slits in each of which is permitted the rocking motion of the leading end of said vertical bar portion of said rocking tumbler in a locked state, and said movable block having grooves extended perpendicular to said relief or tolerance slits for receiving therein the rocking ends of said vertical portions of said T-shaped rocking tumblers which are extended out of said stationary block when said T-shaped rocking tumblers are extended upright substantially perpendicular to said inner and outer card slits; and at least one assembly of a tumbler pin and a driver pin extended through a surface of sliding contact between said stationary and movable blocks on the exterior side of said T-shaped rocking tumblers for axial slidable movement, said assembly being biased in a direction in which a leading end of said tumbler pin is forcibly pressed against said key card, and the length of said tumbler pin being so determined that the surface of contact between said tumbler pin and said driver pin is aligned with said surface of sliding contact between said stationary and movable blocks depending upon whether or not that portion of said key card against which said leading end of said tumbler pin is brought into contact has an engaging hole.

2. A card operated lock as set forth in claim 1 further comprising a guide rod extended through said stationary block in the widthwise direction of said key card and slidably fitted into a longitudinally elongated guide hole formed through said vertical bar portion of each said T-shaped rocking tumbler so that said horizontal bar portion of said each T-shaped rocking tumbler is guided so as to be movable in the direction of thickness of said lock and key cards and so as to be swingable.

3. A card operated lock as set forth in claim 1 wherein each of said detection projections extended from each said T-shaped rocking tumbler has inclined converging edges.

4. A card operated lock as set forth in claim 1 said plurality of rocking tumblers are alternately staggered from each other in the direction in which is inserted said key card so that said plurality of rocking tumblers are arranged in two arrays.

* * * * *